US010932977B2

(12) United States Patent
Liu et al.

(10) Patent No.: US 10,932,977 B2
(45) Date of Patent: Mar. 2, 2021

(54) WAIST ROTATING MECHANISM

(71) Applicant: SHEN ZHEN KUANG-CHI HEZHONG TECHNOLOGY LTD., Guangdong (CN)

(72) Inventors: Ruopeng Liu, Guangdong (CN); Jing Li, Guangdong (CN); Guoxuan Zhang, Guangdong (CN); Liangxuan Shu, Guangdong (CN); Kai Wang, Guangdong (CN)

(73) Assignee: SHEN ZHEN KUANG-CHI HEZHONG TECHNOLOGY LTD, Shenzhen (CN)

( * ) Notice: Subject to any disclaimer, the term of this patent is extended or adjusted under 35 U.S.C. 154(b) by 38 days.

(21) Appl. No.: 16/389,805

(22) Filed: Apr. 19, 2019

(65) Prior Publication Data

US 2019/0240101 A1 Aug. 8, 2019

Related U.S. Application Data

(63) Continuation of application No. PCT/CN2017/092041, filed on Jul. 6, 2017.

(30) Foreign Application Priority Data

Oct. 21, 2016 (CN) ..... 20160921443.3

(51) Int. Cl.
*A61H 1/02* (2006.01)

(52) U.S. Cl.
CPC ..... *A61H 1/02* (2013.01); *A61H 2001/0203* (2013.01); *A61H 2205/08* (2013.01)

(58) Field of Classification Search
CPC ..... A61H 1/02; A61H 2205/08; A61H 2001/0203; A61H 2201/018;
(Continued)

(56) References Cited

U.S. PATENT DOCUMENTS 1,530,519 A * 3/1925 Remington ..... A63B 69/0059 473/216
1,604,118 A * 10/1926 Glancey ..... A63B 21/1681 473/208
(Continued)

FOREIGN PATENT DOCUMENTS

CN 102846450 A 1/2013
CN 103054692 A 4/2013
(Continued)

OTHER PUBLICATIONS

International Search Report dated Oct. 16, 2017 issued in PCT/CN2017/092041.
(Continued)

*Primary Examiner* — Gary D Urbiel Goldner
(74) *Attorney, Agent, or Firm* — Cantor Colburn LLP

(57) ABSTRACT

The present disclosure provides a waist rotating mechanism. The waist rotating mechanism includes: a back connection structure (10), where the back connection structure (10) is configured to connect to the back of a user, and a mobile apparatus (11) is disposed on the back connection structure (10); and a rail (20), where the mobile apparatus (11) is disposed movably on the rail (20). The waist rotating mechanism of the present disclosure enables the user to complete a waist rotation action by rotating the waist to slide the mobile apparatus on the rail, and has a simple structure and high flexibility.

6 Claims, 2 Drawing Sheets

(58) Field of Classification Search

CPC ..... A61H 2201/1671; A61H 2205/081; A61H 2205/088; A61H 1/0292; A61H 2201/0157; A61H 2201/1238; A61H 2201/1246; A61H 2201/1261; A61H 2201/1626; A61H 2201/165; A61H 1/0214; A63B 21/0004; A63B 21/00058; A63B 21/00061; A63B 21/00065; A63B 21/00068; A63B 21/00072; A63B 21/00076; A63B 21/00178; A63B 21/00181; A63B 21/00185; A63B 21/002; A63B 21/0023; A63B 21/008; A63B 21/0083; A63B 21/0084; A63B 21/00845; A63B 21/0085; A63B 21/0087; A63B 21/0088; A63B 21/02; A63B 21/021; A63B 21/022; A63B 21/023; A63B 21/025; A63B 21/026; A63B 21/028; A63B 21/04; A63B 21/0407; A63B 21/0414; A63B 21/0421; A63B 21/0428; A63B 21/0435; A63B 21/0442; A63B 21/045; A63B 21/0455; A63B 21/05; A63B 21/0608; A63B 21/0618; A63B 21/062; A63B 21/0622; A63B 21/0624; A63B 21/0626; A63B 21/0628; A63B 21/063; A63B 21/0632; A63B 21/065; A63B 21/068; A63B 21/15; A63B 21/151; A63B 21/159; A63B 21/16; A63B 21/4007; A63B 21/4009; A63B 21/4027; A63B 21/4039; A63B 21/4041; A63B 21/4045; A63B 21/4047; A63B 21/4049; A63B 22/0015; A63B 22/0017; A63B 22/0046; A63B 22/18; A63B 22/20; A63B 22/201; A63B 22/203; A63B 22/208; A63B 2022/206; A63B 2023/003; A63B 2023/006; A63B 23/02; A63B 23/0205; A63B 23/0211; A63B 23/0216; A63B 23/0222; A63B 23/0227; A63B 23/0223; A63B 23/0238; A63B 23/0244; A63B 26/00; A63B 26/003; A63B 69/0057; A63B 69/0059; A63B 69/0064; A63B 69/3608; A63B 2069/0062; A63B 71/0009; A63B 71/0054; A63B 2071/0063; A63B 2071/0072; A63B 2071/0081; A63B 2225/09; A63B 2225/093; A63B 2225/096

See application file for complete search history.

(56) References Cited

U.S. PATENT DOCUMENTS

| | | | | | |
|---|---|---|---|---|---|
| 2,755,091 | A * | 7/1956 | Hara | A63B 69/3608 | 473/274 |
| 4,340,216 | A * | 7/1982 | Murphy | A61H 3/008 | 105/150 |
| 4,409,969 | A * | 10/1983 | Will | A63B 23/0244 | 602/19 |
| 5,050,885 | A * | 9/1991 | Ballard | A63B 69/3623 | 473/216 |
| 5,127,897 | A * | 7/1992 | Roller | A61F 5/024 | 128/107.1 |
| 5,400,683 | A | 3/1995 | LaFlame | | |
| 5,435,563 | A * | 7/1995 | Salvatore | A63B 69/0059 | 128/870 |
| 5,462,518 | A * | 10/1995 | Hatley | A61F 5/024 | 482/124 |
| 5,868,691 | A * | 2/1999 | Vishnevsky | A61F 5/026 | 128/845 |
| 6,217,482 | B1 * | 4/2001 | Yoo | A63B 19/00 | 482/10 |
| 6,461,256 | B1 * | 10/2002 | Popeck | A63B 69/0059 | 473/450 |
| 6,551,196 | B1 * | 4/2003 | Kossnar | A63B 69/3608 | 473/216 |
| 6,719,640 | B1 * | 4/2004 | Madole | A61F 5/026 | 473/215 |
| 7,086,958 | B2 * | 8/2006 | Eigiro | A63B 69/0059 | 434/252 |
| 7,744,552 | B1 * | 6/2010 | Babcock | A61F 5/026 | 602/19 |
| 8,043,199 | B1 * | 10/2011 | Barker | A63B 22/0069 | 482/140 |
| 9,295,896 | B1 * | 3/2016 | Hoang | A63B 69/3614 | |
| 9,669,258 | B2 * | 6/2017 | Huebner | A63B 21/4007 | |
| 9,744,066 | B2 * | 8/2017 | Kazerooni | A61H 1/0292 | |
| 9,931,537 | B2 * | 4/2018 | Huebner | F16B 7/105 | |
| 10,207,139 | B2 * | 2/2019 | Brancato | A63B 21/4027 | |
| 2008/0161738 | A1 * | 7/2008 | Giesen | A61F 5/026 | 602/19 |
| 2008/0228121 | A1 | 9/2008 | Hughes | | |
| 2009/0270777 | A1 * | 10/2009 | Wu | A61H 7/007 | 601/87 |
| 2013/0085046 | A1 * | 4/2013 | Jolly | A63B 21/4003 | 482/129 |
| 2013/0201021 | A1 * | 8/2013 | Limonadi | A63B 21/0407 | 340/573.7 |
| 2014/0212243 | A1 | 7/2014 | Yagi et al. | | |
| 2016/0000633 | A1 * | 1/2016 | An | A61H 1/0277 | 601/33 |
| 2016/0206497 | A1 * | 7/2016 | Deshpande | A61H 1/0281 | |
| 2017/0106223 | A1 * | 4/2017 | Brancato | A63B 21/4027 | |

FOREIGN PATENT DOCUMENTS

| | | | |
|---|---|---|---|
| CN | 103284822 | A | 9/2013 |
| CN | 206366016 | U | 8/2017 |
| EP | 2764853 | A1 | 8/2014 |
| KR | 20120104742 | A | 9/2012 |
| WO | 2007047914 | A2 | 4/2007 |
| WO | 2012171000 | A1 | 8/2012 |

OTHER PUBLICATIONS

European Search Report for corresponding application EP 17 86 2224. Report dated May 8, 2020.

* cited by examiner

WAIST ROTATING MECHANISM

CROSS-REFERENCE TO RELATED APPLICATIONS

This application is a continuation application of PCT/CN2017/092041, filed Jul. 6, 2017, published as WO 2018/072485, which claims the priority of Chinese Application No. 201610921443.3, filed Oct. 21, 2016. The contents of the above-identified applications are incorporated herein by reference in their entireties.

TECHNICAL FIELD

The present disclosure relates to the waist exoskeleton rotation apparatus field, and more specifically, to a waist rotating mechanism.

BACKGROUND

Along with the development of the robot industry, more and more technology companies in and outside China are investing into the exoskeleton robot research and development field. Therefore, different versions of exoskeleton robots emerge one after another. Flexibility of a waist structure of an exoskeleton robot greatly affects flexibility of the entire robot and comfort for a wearer.

Technical Problem

Currently, waist rotating mechanisms of an exoskeleton robot are categorized into a waist rotating mechanism fixed on a leg part and a waist mechanism disposed independently from a leg part. The waist rotating mechanism fixed on a leg part has only the waist support function and does not have a movable part, and therefore cannot assist or adapt to a user in implementing a waist movement, resulting in poor synchronization of the waist of the user in a use process and low flexibility. The waist mechanism disposed independently from a leg part has no support and has a cumbersome overall structure, and therefore, is likely to cause damage to the waist of the user.

SUMMARY

Solution to Problem

Technical Solution

A main purpose of the present disclosure is to provide a waist rotating mechanism, to solve a prior-art problem that the waist of an exoskeleton cannot be rotated flexibly.

To achieve the foregoing purpose, according to an aspect of the present disclosure, a waist rotating mechanism is provided. The waist rotating mechanism includes: a back connection structure, where the back connection structure is configured to connect to the back of a user, and a mobile apparatus is disposed on the back connection structure; and a rail, where the mobile apparatus is disposed movably on the rail.

Further, the mobile apparatus includes a sliding block, and the sliding block is movably disposed on the rail.

Further, the rail is an arc-shaped sliding rail.

Further, a mounting hole is disposed inside the sliding block, the rail passes through the mounting hole, a cross section of the rail is a polygon, and a cross section of the mounting hole matches the cross section of the rail.

Further, the waist rotating mechanism further includes: a buffering and resetting apparatus, where a first terminal of the buffering and resetting apparatus is connected to the rail, and a second terminal of the buffering and resetting apparatus is connected to the sliding block.

Further, the sliding block is fixedly disposed at a bottom portion of the back connection structure, there are two sliding blocks and two buffering and resetting apparatuses, the two sliding blocks are disposed symmetrically with respect to a center line of the back connection structure, and connection locations of the buffering and resetting apparatuses and the rail are disposed symmetrically with respect to a center line of the rail.

Further, connection lug bosses are disposed at the connection locations of the buffering and resetting apparatuses and the rail, the first terminals of the buffering and resetting apparatuses are hinged to the connection lug bosses, and the second terminals of the buffering and resetting apparatuses are hinged to the sliding blocks.

Further, a limiting protrusion is disposed on the rail, and the limiting protrusion is configured to limit movement of the mobile apparatus.

Further, the buffering and resetting apparatus is a spring.

Further, the spring is a gas spring or a hydraulic spring.

BENEFICIAL EFFECT OF PRESENT DISCLOSURE

Beneficial Effect

By using the technical solution of the present disclosure, a user rotates the waist to drive the back connection structure to move, so that the mobile apparatus slides on the rail along the track of the rail, thereby completing a waist rotation action of the waist rotating mechanism of the present disclosure. The waist rotating mechanism of the present disclosure enables the user to rotate the waist to make the mobile apparatus slide on the rail, thereby completing the waist rotation action; and has a simple structure and high flexibility.

BRIEF DESCRIPTION OF DRAWINGS

Description of Drawings

Figure 1:
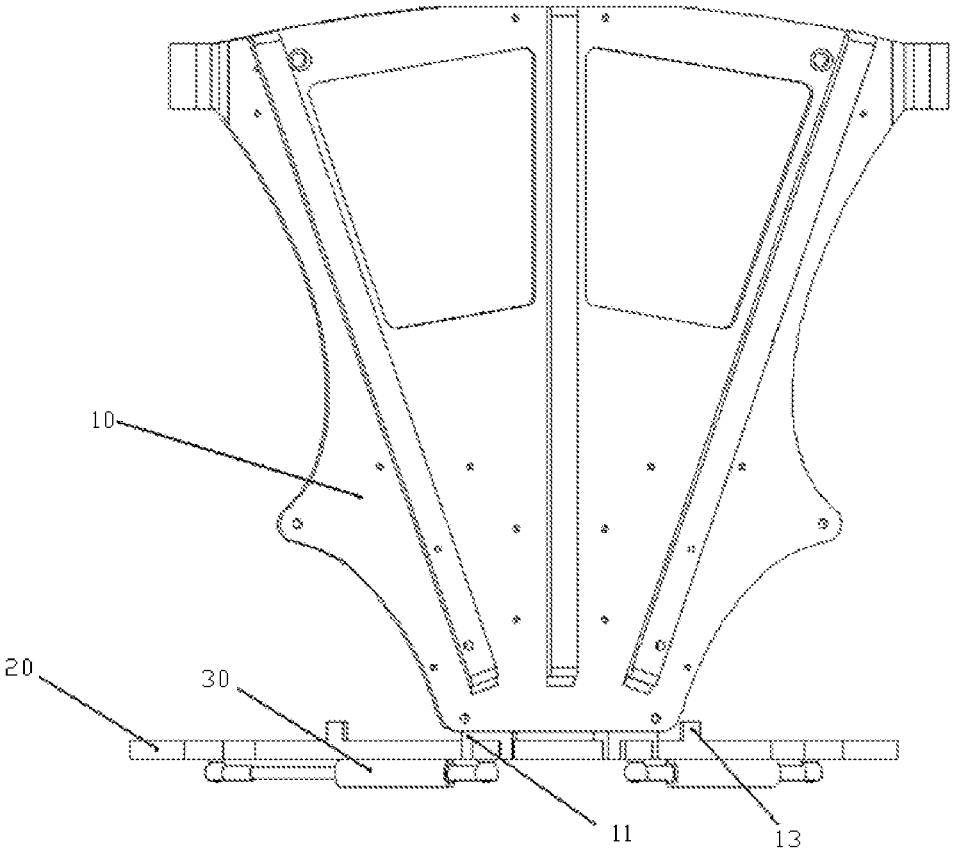
Figure 2:
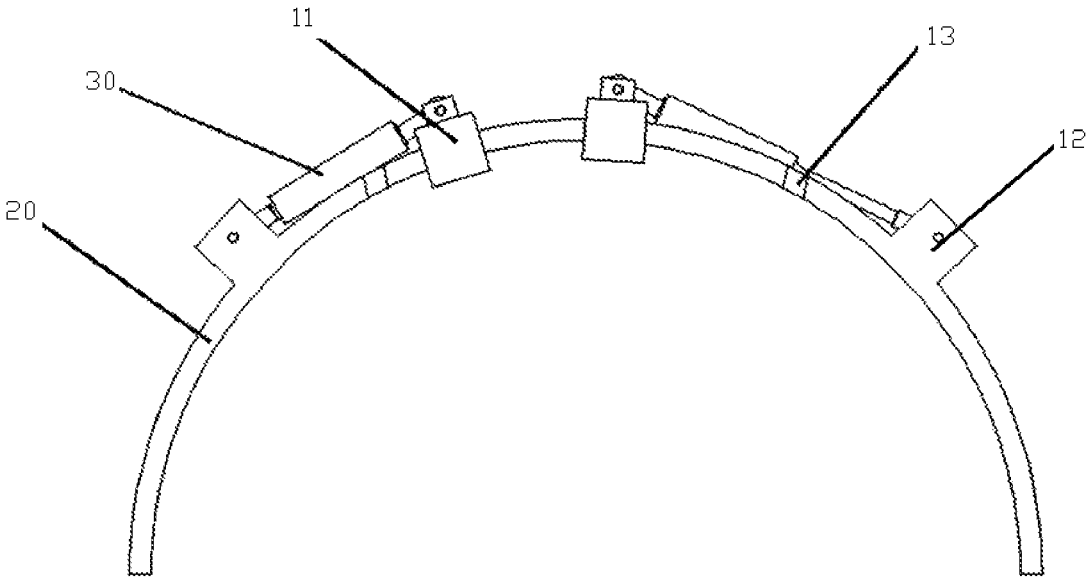

The drawings of the specification that constitute a part of this application provide further understanding of the present disclosure. The illustrative embodiments of the present disclosure and corresponding descriptions are intended to explain the present disclosure rather than constituting improper limitation to the present disclosure. In the drawings:

FIG. 1 schematically shows a structural diagram of a waist rotating mechanism according to an embodiment of the present disclosure; and FIG. 2 schematically shows a schematic top view of a waist rotating mechanism according to an embodiment of the present disclosure.

The foregoing drawings include the following reference numerals:

10: back connection structure; 11: mobile apparatus; 12: connection lug boss; 13: limiting protrusion; 20: rail; and 30: buffering and resetting apparatus.

DESCRIPTION OF EMBODIMENTS

Embodiments of Present Disclosure

It should be noted that the embodiments of this application and features in the embodiments may be mutually combined without conflicts. The following describes the present disclosure in detail with reference to the accompanying drawings in combination with the embodiments.

It should be noted that the following detailed descriptions are merely illustrative and are intended to provide further description of this application. Unless otherwise stated, the technological and scientific terms used in this application have the same meanings as those generally understood by a person of ordinary skill in the technological field to which this application pertains.

It should be noted that the terms used herein are merely intended to describe specific implementations rather than limiting the example implementations according to this application. For example, unless otherwise stated in the context, a singular form used herein is also intended to cover a plural form. In addition, it should be further understood that when the term(s) "comprise" and/or "include" are/is used in the specification, it indicates existence of a feature, a step, an operation, a component, an element, and/or a combination thereof.

It should be noted that the terms "first", "second", and the like in the description, claims, and the foregoing accompanying drawings of this application are used to distinguish between similar objects, but are not necessarily used to describe a specific order or sequence. It should be understood that the numbers used in this way are exchangeable when appropriate, so that the implementations of this application described herein may be executed in a sequence other than the sequences illustrated or described herein.

In addition, the terms "include" and "have" and any of their variations are intended to cover non-exclusive inclusion. For example, a process, method, system, product, or device including a series of steps or units is not necessarily limited to the clearly listed steps or units, and may include other steps or units that are not clearly listed or that are inherent to the process, method, product, or device.

For ease of description, spatially relative terms may be used herein. For example, "on the top of", "above", "on the upper surface of", and "upper" are used to describe a spatial location relationship between a component or a feature and another component or feature shown in the figures. It should be understood that the spatially relative terms are intended to include different orientations of the component in use or operation in addition to the orientation depicted in the figures.

For example, if the component in the accompanying drawings is turned over, components described as "above another component or construction" or "on the top of another component or construction" would then be oriented "below the another component or construction" or "underneath the another component or construction". Thus, a term such as "above" can encompass both an orientation of "above" and an orientation of "below". The component may be otherwise oriented, for example, rotated 90 degrees or at other orientations, and the spatially relative descriptions used herein are interpreted accordingly.

As described in the Background, exoskeleton robots are developing rapidly at present. A structure of a wearable exoskeleton affects comfort for a wearer and overall flexibility of the exoskeleton. To meet the requirements of the intelligent structure of a wearable exoskeleton robot, a movable rotary joint needs to be designed for the waist of the exoskeleton robot to assist a user in moving sideways by rotating the waist.

As shown in FIG. 1, the present disclosure provides a waist rotating mechanism. An embodiment of the waist rotating mechanism includes: a back connection structure 10 and a rail 20. The back connection structure 10 is configured to connect to the back of a user, a mobile apparatus 11 is disposed on the back connection structure 10, and the mobile apparatus 11 is disposed movably on the rail 20. During installation, the back connection structure 10 is connected to the back of user, and the rail is connected to another apparatus. The mobile apparatus 11 on the back connection structure 10 is movably installed on the rail 20. During operation, the user rotates the waist to drive the back connection structure 10 to move, so that the mobile apparatus 11 slides on the rail 20 along the track of the rail 20, thereby completing a waist rotation action of the waist rotating mechanism of the present disclosure. The waist rotating mechanism of the present disclosure enables the user to complete the waist rotation action by rotating the waist to slide the mobile apparatus 11 on the rail 20, and has a simple structure and high flexibility.

A connecting manner between the back connection structure 10 of the present disclosure and the back of the user may be suspender-type connection. To be specific, a connecting block for connecting a suspender is disposed on the back connection structure 10, and there are two connecting blocks. The two connecting blocks are respectively disposed at two ends of the back connection structure 10, two ends of a suspender are connected to the two connecting blocks, and the suspender is arranged at the back of the user. Certainly, other manners that can connect the back connection structure 10 to the back of the user are also applicable.

Specifically, the mobile apparatus 11 of the present disclosure includes a sliding block, and the sliding block is movably disposed on the rail 20. During installation, the back connection structure 10 is connected to the back of the user by using a suspender or in another connecting manner. The sliding block of the back connection structure 10 is movably installed on the rail 20. During operation, the user rotates the waist to drive the back connection structure 10 to move, so that the sliding block slides on the rail 20 along the track of the rail 20, thereby completing the waist rotation action of the waist rotating mechanism of the present disclosure.

As shown FIG. 2, in order to achieve a smoother waist rotation process of the user thereby improving comfort of use for the user, preferably, the rail 20 of the present disclosure is an arc-shaped sliding rail. In a process in which the back connection structure 10 is rotated by the user, the sliding block slides on the arc-shaped sliding rail. Because a track of the arc-shaped sliding rail is in higher conformity with a track of the waist rotation process of the user, the rotation process of the user is smoother.

To make the waist rotating mechanism of the present disclosure adapt to figures of different users, preferably, a stretchable mechanism, for example, a sleeve/pin-type stretchable mechanism, is disposed on the rail 20 of the present disclosure. There may be one or more stretchable mechanisms. Certainly, other stretchable mechanisms that can be used adjust a track length and direction of the rail are also applicable. During operation, when a length of the rail 20 of the waist rotating mechanism of the present disclosure affects comfort of user for the user, the stretchable mechanism is adjusted so that the length of the rail meets a waist rotation requirement of the user.

A stretching track of the stretchable mechanism of the present disclosure may be the same as the track of the rail 20 of the present disclosure, or the stretching track of the stretchable mechanism of the present disclosure may be different from the track of the rail 20 of the present disclosure. For example, the stretching track of the stretchable mechanism is set to a straight line. During operation, the stretchable mechanism is extended along a straight line, thereby adjusting an accommodating waistline of the waist rotating mechanism of the present disclosure. Certainly, alternatively, a stretchable mechanism with another stretching track may be disposed to meet different rotation or wearing requirements of the waist rotating mechanism of the present disclosure.

To enable the sliding block of the present disclosure to slide more stably on the rail 20, preferably, a mounting hole is disposed inside the sliding block, and the rail 20 passes through the mounting hole. During operation, in a waist rotation process of the user, because the sliding block is disposed on the rail 20 in a sleeving manner, so that the sliding block does not fall off from the rail, thereby ensuring stability of the waist rotating mechanism of the present disclosure during rotation.

To prevent the back connection structure 10 of the present disclosure from rotating along the rail 20, a cross section of the rail 20 of the present disclosure is a polygon, and a cross section of the installation matches the cross section of the rail 20. The cross section of the rail 20 of the present disclosure may be a triangle, a quadrangle, a pentagon, or the like. For example, when the cross section of the rail 20 of the present disclosure is a triangle, during operation, corner locations of the triangle of the cross section of the rail 20 can prevent the back connection structure 10 from rotating along the rail 20.

The waist rotating mechanism of the present disclosure is driven by a waist movement of the user. Therefore, during operation, if a rotation speed is excessively fast or an angle of rotation is excessively large when the user rotates the waist rotating mechanism, this may cause a sprain to the waist of the user. To avoid the foregoing situation, preferably, the waist rotating mechanism of the present disclosure further includes a buffering and resetting apparatus 30. A first terminal of the buffering and resetting apparatus 30 is connected to the rail 20, and a second terminal of the buffering and resetting apparatus 30 is connected to the sliding block. When the user rotates after wearing the waist rotating mechanism of the present disclosure, the buffering and resetting apparatus 30 generates resistance against a movement of the back connection structure 10, and the resistance increases as a rotation angle of the user increases, thereby limiting a rotation speed and angle of the waist of the user and protecting the waist of the user from being sprained.

Specifically, the sliding block of the present disclosure is fixedly disposed at a bottom portion of the back connection structure 10. To allow the back connection structure 10 of the present disclosure to return to a initial location, where the initial location is a location of the back connection structure 10 when the user does not rotate the waist, there are two sliding blocks and two buffering and resetting apparatuses 30, the two sliding blocks are disposed symmetrically relative to a center line of the back connection structure 10, connection locations of the buffering and resetting apparatuses 30 and the rail 20 are disposed symmetrically with respect to a center line of the rail 20, and the two buffering and resetting apparatuses 30 are used to ensure that the rail 20 can return to the initial location. During operation, the back connection structure 10 is located at the initial location at the beginning, the user rotates the waist to make the back connection structure 10 move, and the back connection structure 10 encounters resistance from the two buffering and resetting apparatuses 30 during the movement process, to protect the waist of the user from getting sprained due to an excessive rotation speed. After the user completes rotation, thrust forces of the two buffering and resetting apparatuses 30 cancel each other, making the back connection structure 10 return to the initial location.

To make the connection between the buffering and resetting apparatus 30 and the rail 20 of the present disclosure more stable, preferably, connection lug bosses 12 are disposed at the connection locations of the buffering and resetting apparatuses 30 and the rail 20, the first terminals of the buffering and resetting apparatuses 30 are hinged to the connection lug bosses 12, and the second terminals of the buffering and resetting apparatuses 30 are hinged to the sliding blocks. During operation, in a process in which the sliding block moves on the rail 20, the first terminal of the buffering and resetting apparatus 30 moves using a joint point on the bosses 12 as a center, and the second terminal of the buffering and resetting apparatus 30 moves using a joint point on the sliding block as a center. Certainly, other connecting manners that can be used to connect the buffering and resetting apparatus 30 stably to the rail 20 are also applicable.

The waist rotating mechanism of the present disclosure is driven by a waist movement of the user. Therefore, during operation, if a rotation angle of rotating the waist rotating mechanism by the user is excessively large, the waist of the user may get sprained. To avoid the foregoing situation, preferably, a limiting protrusion 13 is disposed on the rail 20. The limiting protrusion 13 is configured to limit movement of the mobile apparatus 11. During operation, the user rotates the waist to drive the back connection structure 10 to move, making the sliding block slide on the rail 20 along the track of the rail 20. When the sliding block moves to the limiting protrusion 13, the sliding block is obstructed by the limiting protrusion 13 and stops moving, thereby avoiding the problem that the user gets sprained because a movement angle of the back connection structure 10 is excessively large.

To meet the buffering and restoring functions of the buffering and resetting apparatuses 30, preferably, the buffering and resetting apparatuses 30 of the present disclosure are springs. During operation, the back connection structure 10 is located at the initial location at the beginning, the user rotates the waist to make the back connection structure 10 move, and the back connection structure 10 encounters resistance from the two springs during the movement process, to protect the waist of the user from getting sprained due to an excessive rotation speed. After the user completes rotation, thrust forces of the two springs cancel each other, making the back connection structure 10 return to the initial location. In the present disclosure, the two springs have a same specification. At the initial position, the two springs are both in a compressed state. When the sliding block on the back connection structure 10 moves towards a first terminal of the rail 20, the spring at the first terminal continues to be compressed, and the spring at a second terminal is still in a compressed state. However, in comparison with the initial location, the spring at the second terminal becomes longer. In this case, a thrust force on the back connection structure 10 from the spring at the first terminal is greater than a thrust force on the back connection structure 10 from the spring at the second terminal. In this case, a joint force of the thrust forces of the springs at the two ends points at the initial location. Therefore, the user encounters resistance in a process of moving towards the first terminal, to avoid getting sprained due to extremely fast rotation.

The back connection structure 10 of the present disclosure is a connecting plate, to improve a strength of the back connection structure 10 of the present disclosure, preferably, a reinforcing rib is further disposed on the back connection structure 10 of the present disclosure. There are multiple reinforcing ribs, and the reinforcing ribs are disposed symmetrically with respect to a center line of the connecting plate.

When the sliding block on the back connection structure 10 moves towards the second terminal of the rail 20, the spring at the second terminal continues to be compressed, and the spring at the first terminal is still in a compressed state. However, in comparison with the initial location, the spring at the first terminal becomes longer. In this case, a thrust force on the back connection structure 10 from the spring at the second terminal is greater than a thrust force on the back connection structure 10 from the spring at the first terminal. In this case, a joint force of the thrust forces of the springs at the two ends points at the initial location. Therefore, the user encounters resistance in a process of moving towards the second terminal, to avoid getting sprained due to extremely fast rotation.

Preferably, the springs of the present disclosure are gas springs or hydraulic springs. Certainly, a structure that can implement the function of the buffering and resetting apparatus 30 of the present disclosure is also applicable.

The waist rotating mechanism proposed in the present disclosure uses a structure including the arc-shaped sliding rail and the sliding block. The track is connected to the lower limbs, and the sliding block is fixed to the upper body. The mechanism enables an exoskeleton robot to make a circular movement by using the center axis of the waist of a human body as the center axis of rotation, effectively improving the movable range of and comfort for the user. The cross sections of the rail 20 and the sliding block use a polygon design. This implements connection of the lower limbs and the upper body of the exoskeleton of the robot, and also prevents the upper body from making a circular movement around the rail, so that the upper body can only make a circular movement along a direction of the rail 20 in this mechanism.

Preferably, the rail 20 of the present disclosure may not be a sliding rail with a standard circular track, provided that normal waist rotation of the user is not obstructed. Different sizes may be designed for the rail 20 and the sliding block of the present disclosure based on different load bearing requirements.

Springs are added on two sides of the mechanism to limit the initial location of movement, enabling the waist of a wearer to return to the initial location without action of active force. Besides, a movement speed of the mechanism can be further limited in the present disclosure, to exert a buffering effect and improve comfort and security for the user.

In the present disclosure, not only flexibility of the exoskeleton robot and comfort for the wearer are improved, the center of gravity can also be adjusted when the user bears a load. When the user moves ahead under burden, the upper body tilts to the left or right along with the steps. The waist rotating mechanism of the present disclosure can adapt to the tilt to make the center of gravity move towards the supporting foot side. In addition, the springs on the two sides can buffer a deflecting force generated during the walking, to reduce a tilting speed of the user and improve the overall stability. The mobile apparatus is movably disposed on the rail. The rail uses an arc-shaped design to better fit the waist of a human body, improving comfort for the user.

The foregoing descriptions are merely preferable embodiments of the present disclosure, and are not intended to limit the present disclosure. For persons skilled in the art, the present disclosure may have various modifications and variations. Any modification, equivalent replacement, and improvement made within the spirit and principle of the present disclosure shall fall within the protection scope of the present disclosure.

The invention claimed is:

1. A waist rotating mechanism comprising:

a back connection structure configured to connect to a back of a user;

a rail disposed on a bottom portion of the back connection structure, the rail having a polygonal-shaped cross-section;

a pair of sliding blocks movably disposed on the rail and symmetrically disposed with respect to a center line of the back connection structure, each sliding block comprising a mounting hole through which the rail passes, wherein a cross-section of the mounting hole matches the polygonal-shaped cross-section of the rail; and a pair of buffering and resetting apparatuses, each buffering and resetting apparatus comprising a first terminal and a second terminal, wherein the first terminals are respectively connected to the rail at a pair of connection locations, the pair of connection locations being symmetrically disposed with respect to a center line of the rail, and wherein the second terminals are respectively connected to the pair of sliding blocks.

2. The waist rotating mechanism according to claim 1, wherein the rail is an arc-shaped sliding rail.

3. The waist rotating mechanism according to claim 1, wherein a pair of connection lug bosses is respectively disposed at the pair of connection locations and respectively hinged to the first terminals, and wherein the second terminals are respectively hinged to the pair of sliding blocks.

4. The waist rotating mechanism according to claim 1, wherein a pair of limiting protrusions is symmetrically disposed on the rail, and the pair of limiting protrusions is configured to respectively limit movement of the pair of sliding blocks.

5. The waist rotating mechanism according to claim 1, wherein each buffering and resetting apparatus is a spring.

6. The waist rotating mechanism according to claim 5, wherein the spring is a gas spring or a hydraulic spring.

* * * * *